US011110739B2

(12) United States Patent
Mackey et al.

(10) Patent No.: US 11,110,739 B2
(45) Date of Patent: Sep. 7, 2021

(54) FRAMING SQUARE

(71) Applicant: Milwaukee Electric Tool Corporation, Brookfield, WI (US)

(72) Inventors: Eric Mackey, Milwaukee, WI (US); Kenan W. McCutcheon, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 215 days.

(21) Appl. No.: 16/409,392

(22) Filed: May 10, 2019

(65) Prior Publication Data

US 2019/0329586 A1 Oct. 31, 2019

Related U.S. Application Data

(63) Continuation of application No. PCT/US2019/028969, filed on Apr. 24, 2019.
(Continued)

(51) Int. Cl.
*B43L 7/027* (2006.01)
*B25H 7/02* (2006.01)
(Continued)

(52) U.S. Cl.
CPC ..... *B43L 7/027* (2013.01); *B25H 7/02* (2013.01); *B43L 9/007* (2013.01); *B43L 9/04* (2013.01); *B43L 13/00* (2013.01)

(58) Field of Classification Search
CPC .... B43L 7/027; B43L 7/02; B43L 7/10; B43L 13/00; B43L 9/04; B43L 9/007; B25H 7/02
(Continued)

(56) References Cited

U.S. PATENT DOCUMENTS 765,300 A * 7/1904 Williams ..... B43L 9/04 33/27.03
1,463,605 A * 7/1923 Walters ..... G01B 3/56 33/476
(Continued)

FOREIGN PATENT DOCUMENTS

CN 2663089 12/2004
CN 100369759 2/2008
(Continued)

OTHER PUBLICATIONS

International Search Report and Written Opinion for International Application No. PCT/US2019/028969 dated Aug. 27, 2019, 13 pages.

*Primary Examiner* — Christopher W Fulton
(74) *Attorney, Agent, or Firm* — Reinhart Boerner Van Deuren s.c.

(57) ABSTRACT

A framing square including an integrated protractor feature is provided. The framing square includes a blade section, and a tongue section joined at a corner section. The corner section further includes a pivot opening, to rotatably couple the framing square to a workpiece. The blade section includes an array of marking openings. The marking openings are spaced from each other in the array, and the array is positioned a first distance from the pivot opening along a longitudinal axis of the blade. The marking openings can be sized to receive a particular marking instrument (e.g., a pencil or knife) for use with a particular framing square.

19 Claims, 3 Drawing Sheets

Related U.S. Application Data

(60) Provisional application No. 62/663,868, filed on Apr. 27, 2018.

(51) Int. Cl.
*B43L 9/04* (2006.01)
*B43L 9/00* (2006.01)
*B43L 13/00* (2006.01)

(58) Field of Classification Search
USPC ..... 33/26, 27.01, 27.03, 474, 476
See application file for complete search history.

(56) References Cited

U.S. PATENT DOCUMENTS 1,570,150 A 1/1926 Hinds
1,588,962 A * 6/1926 Harrison ..... B25H 7/04 33/476
1,882,354 A 10/1932 Celenza
2,470,035 A * 5/1949 Hudkins ..... B43L 7/027 33/418
3,137,072 A 6/1964 Henson
3,142,906 A 8/1964 Mitsos
4,095,346 A * 6/1978 Cox ..... B43L 7/027 33/476
4,200,990 A * 5/1980 West ..... G01B 3/004 33/476
4,227,314 A 10/1980 Schliep
4,317,289 A 3/1982 Conn
4,513,510 A 4/1985 Swanson
4,641,435 A 2/1987 Brown
4,700,489 A 10/1987 Vasile
5,253,426 A * 10/1993 Mosbrucker ..... B43L 7/027 33/429
5,276,973 A 1/1994 Rakauskas
5,421,093 A 6/1995 Davidson, Jr.
5,535,523 A 7/1996 Endris
5,778,547 A 7/1998 Wolken
6,289,594 B1 * 9/2001 Wrobbel ..... B43L 7/02 33/42
6,336,274 B1 1/2002 Ness Webster
6,467,179 B1 * 10/2002 Wolf ..... B43L 7/027 33/465
6,662,460 B2 12/2003 Evans
6,688,014 B1 2/2004 Allemand
6,792,687 B2 9/2004 Arent et al.
6,820,345 B2 11/2004 Evans
6,868,616 B2 3/2005 Allemand
D511,698 S 11/2005 Allemand
7,337,550 B2 3/2008 Marcus
7,398,601 B2 7/2008 Morrell
7,591,076 B2 9/2009 Varnedoe
7,596,877 B2 10/2009 Basford
7,845,083 B1 12/2010 Cora Rosa
D640,944 S 7/2011 Elias
8,074,368 B2 12/2011 Atwood
8,763,265 B2 7/2014 Herniman et al.
D738,234 S 9/2015 Larson
D741,731 S 10/2015 Lamanna
9,180,725 B2 11/2015 Lin
9,310,175 B2 4/2016 Cook
9,546,867 B2 1/2017 Lueck et al.
2007/0220764 A1 9/2007 Wolken
2009/0193670 A1 * 8/2009 Fernandes ..... B43L 9/007 33/27.03
2012/0159797 A1 6/2012 Roth
2012/0266471 A1 10/2012 Chao
2012/0311880 A1 12/2012 Doggett
2013/0227846 A1 9/2013 Buzzell
2014/0373373 A1 12/2014 Hershkovich
2016/0271789 A1 9/2016 Foster
2019/0225009 A1 * 7/2019 Hummel ..... B43L 7/12

FOREIGN PATENT DOCUMENTS

CN 206106749 4/2017
JP 2009184333 8/2009
WO WO07111870 10/2007

* cited by examiner

FRAMING SQUARE

CROSS-REFERENCE TO RELATED PATENT APPLICATION

The present application is a continuation of International Application No. PCT/US2019/028969 filed Apr. 24, 2019, which claims the benefit of and priority to U.S. Provisional Application No. 62/663,868, filed on Apr. 27, 2018, which are incorporated herein by reference in their entireties.

BACKGROUND OF THE INVENTION

The present invention generally relates to the field of tools. The present invention relates specifically to a framing square with an integrated protractor feature. In general, a framing square is a tool used by carpenters to make measurements, to find right angles, etc.

SUMMARY OF THE INVENTION

One embodiment of the invention relates to a framing square. The framing square includes a blade, a solid region, a marking region, a tongue, a corner section a pivot opening and two or more marking openings. The blade extends in a first direction along a longitudinal axis. The blade includes a solid region that extends a length along the longitudinal axis of the blade and a marking region coupled to the solid region of the blade and extending along the longitudinal axis of the blade. The tongue extends in a second direction along a transverse axis perpendicular to the blade. The tongue includes a solid region extending a length along the transverse axis of the tongue. The corner section couples the solid region of the blade to the solid region of the tongue. The pivot opening is defined within the corner section. Two or more marking openings are formed in the blade. The marking openings include a distance between a center of a first marking opening and a center of a last marking opening. The distance is less than a length of the solid region of the blade along the longitudinal axis.

Another embodiment of the invention relates to a framing square. The framing square includes a blade, a solid region, a marking region, a tongue, a corner section, a pivot opening, and two or more marking openings. The blade extends in a first direction along a longitudinal axis. The blade includes a solid region extending a length along the longitudinal axis of the blade and a marking region coupled to the solid region of the blade that extends along the longitudinal axis of the blade. The tongue extends in a second direction along a transverse axis perpendicular to the blade. The tongue includes a solid region that extends a length along the transverse axis of the tongue. The corner section couples the solid region of the blade to the solid region of the tongue. The pivot opening is defined within the corner section. Two or more marking openings are formed in the blade. The marking openings include a distance between a center of a first marking opening and a center of a last marking opening. The distance is less than a length of the solid region of the blade along the longitudinal axis.

Another embodiment of the invention relates to a method of forming an arc-shaped marking using a framing square. The method includes positioning a framing square in contact with a surface of a workpiece. Positioning a pivot through a pivot opening defined within the framing square. Positioning a marking utensil through a marking opening formed through the framing square, wherein the marking opening is located a first distance from the pivot. And rotating the framing square and marking utensil about the pivot, such that an arc-shaped mark is formed by the marking utensil on the surface of the workpiece. A radius of the arc-shaped mark corresponds to the first distance between the pivot opening and the marking opening.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, a framing square including a protractor feature is shown according to an exemplary embodiment. The framing square discussed herein includes a blade section joined to a tongue section at a right angle at a corner or heel section. The blade section and/or tongue section includes a series of measuring indicia located along inner and/or outer edges of the blade and/or tongue sections.

The framing square discussed herein includes an innovative arrangement of holes or apertures providing protractor functionality to the framing square. In particular, the framing square includes a pivot point or pivot opening generally located adjacent to the corner section and an array of a plurality of marking openings formed in the blade section. The marking openings are generally located at different preselected, fixed distances from the pivot opening. Marking openings are generally spaced at distances that relate to common radius lengths for arc-shapes that a user may need to mark out on a workpiece (e.g., doorway arches, window arches, etc.).

In use, the user fixes the framing square in place by placing a pointed tool or fastener through the pivot hole. Next, the user places a writing or marking tool or utensil through the marking hole corresponding to the desired radius of the arc the user intends to mark out. Then by pivoting the framing square around the pivot hole, an arc of the desired radius is marked out on a workpiece.

In various embodiments, the pivot opening and marking openings are collinear with each other, and in the specific embodiments shown, the pivot opening and marking openings also reside generally along the longitudinal midline of the blade section of the framing square.

In addition, in various embodiments, the framing square discussed herein includes a limited or select number of marking openings specifically located for marking of arcs having a radius as determined by the distance between the pivot opening and the marking opening. In contrast to some framing square designs that include a large number of holes along the blade section, the relatively small number of openings located at select locations of the present framing square design provides for easy to use protractor functionality for the select number of desired arc sizes. Further, the central location of the pivot openings and marking openings alone or in combination with the relatively low number of openings through the blade section are believed to result in a robust and strong framing square, at least as compared to framing square designs including a large number of holes located adjacent to the edge of the framing square.

Figure 1:
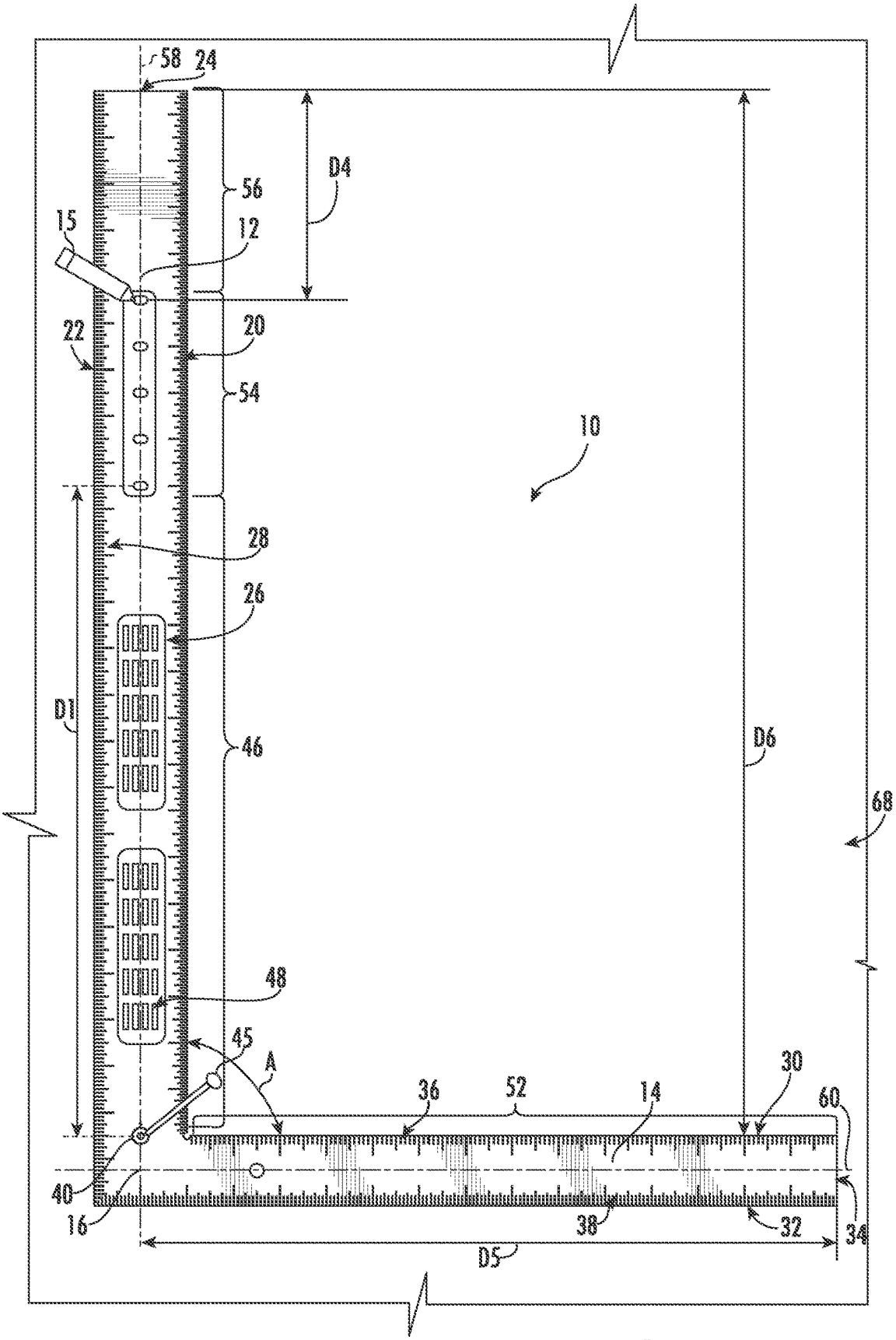
FIG. 1 is a top view of a framing square, according to an exemplary embodiment.

Referring to FIG. 1, a framing square 10 is shown. Framing square 10 includes a first section, shown as blade 12, a second section, shown as tongue 14, and a heel or corner section 16 coupled to the solid region 46 of the blade 12 and the solid region 52 of the tongue 14. As shown in FIG. 1, blade 12 is joined to tongue 14 by corner section 16 such that a right angle, shown as angle A, is formed between blade 12 and tongue 14. In other words, corner section 16 interconnects blade 12 and tongue 14, such that blade 12 is coupled to tongue 14 at a right angle. In some embodiments, blade 12 and tongue 14 form a rectangular shaped section such that tongue 14 intersects blade 12 at a 90° angle, for example, at corner section 16. In some embodiments, blade 12 is longer than tongue 14.

Blade 12 comprises a first or proximal solid region 46, a marking region 54, and/or a second or distal solid region 56. In general, blade 12 is an elongate, generally rectangular shaped section extending along a longitudinal axis 58 and including an inner longitudinal edge 20, an outer longitudinal edge 22, wherein a distance between inner longitudinal edge 20 and outer longitudinal edge 22 defines an outer minor edge 24. The length of outer minor edge 24 defines a width of blade 12. As shown in FIG. 1, inner longitudinal edge 20 is parallel to outer longitudinal edge 22, and outer minor edge 24 is perpendicular to both edges 20 and 22. Blade 12 includes a first series of measuring indicia 26 located along inner longitudinal edge 20 and a second series of measuring indicia 28 located along outer longitudinal edge 22.

In general, tongue 14 is an elongate, generally rectangular shaped section including an inner transverse edge 30, an outer transverse edge 32, and an outer minor edge 34. As shown in FIG. 1, tongue 14 extends along transverse axis 60, which extends in a direction perpendicular to longitudinal axis 58. Inner transverse edge 30 is parallel to outer transverse edge 32, and outer minor edge 34 is perpendicular to transverse axis 60 as well as both transverse edges 30 and 32. Tongue 14 includes a first series of measuring indicia 36 located along inner transverse edge 30 and a second series of measuring indicia 38 located along outer transverse edge 32.

In some embodiments, framing square 10 includes an inner longitudinal edge 20 parallel to an opposite outer longitudinal edge 22 extending along blade 12. An inner transverse edge 30 parallel to an opposite outer transverse edge 32 extends along tongue 14. In some embodiments, pivot opening 40 forms on a boundary at the intersection of corner section 16 and blade 12. Pivot opening 40 is collinear with inner transverse edge 30 of tongue 14. For example, pivot opening 40 is centered on a midline longitudinal axis 58 of blade 12.

Blade 12 defines a width which is the dimension perpendicular to longitudinal axis 58 and edges 20 and 22. For example, the width is the length of outer minor edge 24. Tongue 14 defines a width which is the dimension perpendicular to transverse axis 60 and edges 30 and 32. For example, the width is the length of outer minor edge 34. In the embodiment of FIG. 1, the width of tongue 14 (e.g., outer minor edge 34) is less than the width of blade 12 (e.g., outer minor edge 24). In some embodiments, a width of blade 12 measured in a perpendicular direction to longitudinal axis 58 is greater than a width of tongue 14 measured in a perpendicular direction to transverse axis 60.

Corner section 16 interconnects blade 12 to tongue 14. Stated differently, corner section 16 couples proximal solid region 46 of blade 12 to solid region 52 of tongue 14. In some embodiments, a pivot point or pivot opening 40 is formed or defined within corner section 16. For example, pivot opening 40 is formed through a boundary between corner section 16 and blade 12, such that the pivot opening 40 is collinear with the inner edge of the tongue 14. In other embodiments, pivot opening 40 is centered within corner section 16, such that pivot opening lies along either a midline longitudinal axis 58 or a midline transverse axis 60. In some embodiments, pivot opening lies on both a midline longitudinal axis 58 and transverse axis 60.

In various embodiments, blade 12, tongue 14, and corner section 16 are formed from a single, integral, contiguous piece of material (e.g., a metal material, steel, aluminum, wood, plastic, etc.). Measurement indicia 26, 28, 36, and 38 may be printed, etched, engraved, painted, etc. on the upper and/or lower faces of blade 12 and/or on the upper and/or lower faces of tongue 14 along longitudinal edges 20 and 22 and/or transverse edges 30 and 32, as discussed above.

Blade 12 extends along longitudinal axis 58 and includes proximal solid region 46 coupled to corner section 16, marking region 54 coupled to proximal solid region 46, and distal solid region 56 coupled to marking region 54. Marking region 54 interconnects proximal solid region 46 to distal solid region 56 in such a way that each of proximal solid region 46, marking region 54, and distal solid region 56 extend along longitudinal axis 58 and define blade 12.

Figure 2:
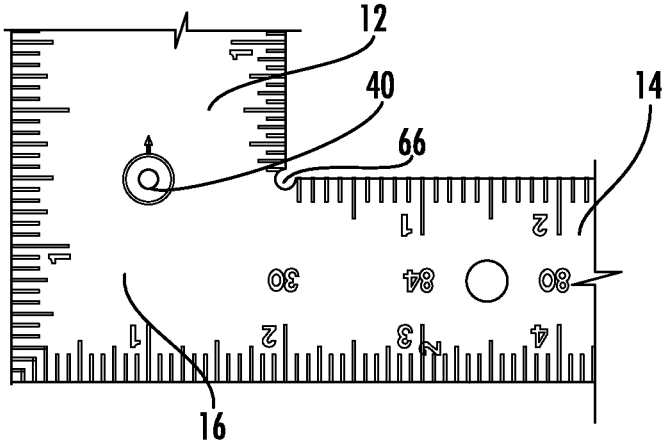
FIG. 2 is a detailed top view of a corner section of the framing square of FIG. 1, according to an exemplary embodiment.

As noted above, framing square 10 includes a protractor feature that allows the user to mark out a variety of different arc shapes having a preselected radius for various common shaped openings, such as doorways or window arches. Referring to FIG. 2, the protractor feature includes a pivot opening 40 located adjacent to corner section 16. In the particular embodiment shown, pivot opening 40 is aligned in the lengthwise direction (relative to blade 12) with the zero point of the series of measuring indicia 26.

Figure 3:
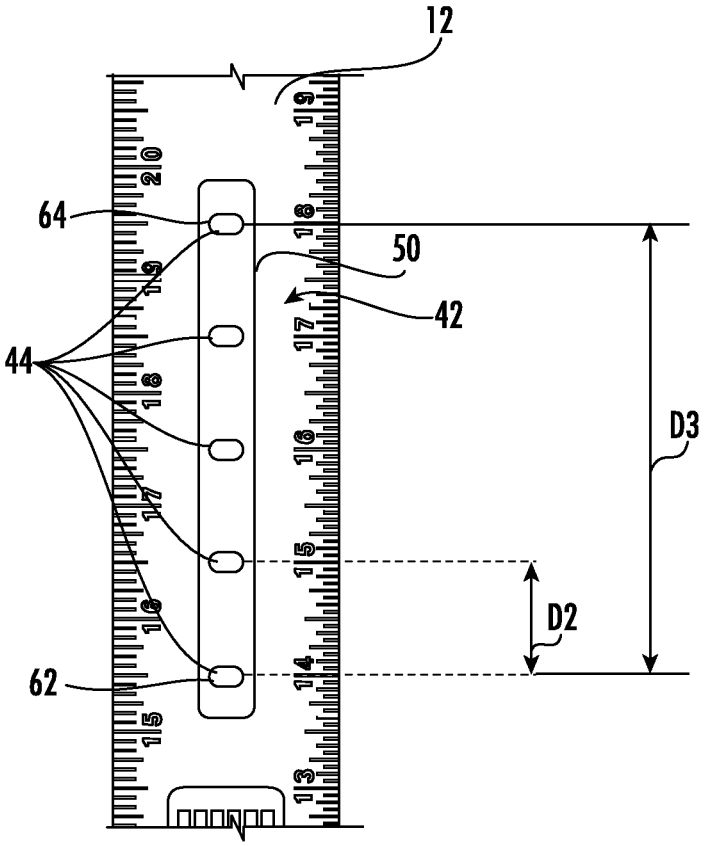
FIG. 3 is a detailed top view of an array of marking openings formed in the blade section of the framing square of FIG. 1, according to an exemplary embodiment.
Figure 4:
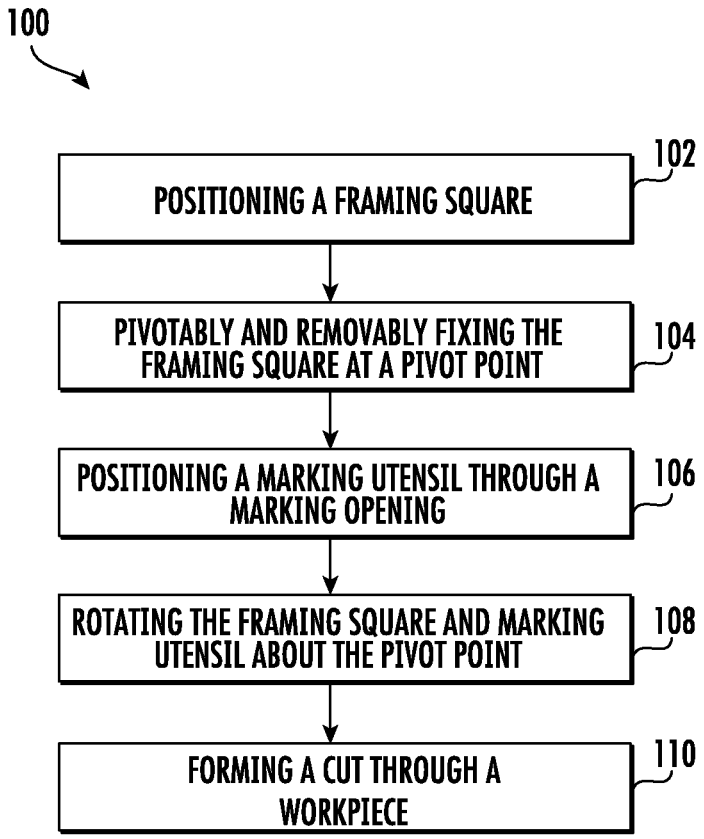
FIG. 4 is a flowchart showing a method for forming an arc-shaped marking using the framing square of FIG. 1, according to an exemplary embodiment.

As shown in FIG. 3, the protractor feature includes an array 42 of marking openings 44. As shown best in FIG. 1, in a specific embodiment, pivot opening 40 and each opening 44 of array 42 are collinear with each other and specifically, reside along a midline longitudinal axis 58 (e.g., longitudinal axis 58 is parallel to and equidistant from longitudinal edges 20 and 22).

In general, pivot opening 40 is spaced a distance D1 from the first marking opening 44 of array 42. D1 is selected based on a radius of an arc commonly marked by the user of framing square 10. In various embodiments, D1 is greater than 6 inches, specifically greater than 10 inches and more specifically is greater than 12 inches. In such embodiments, D1 may also be less than 20 inches, specifically less than 18 inches and more specifically less than 16 inches. In various embodiments, the region 46 of blade 12 located between array 42 and pivot opening 40 is a region 46 that does not include any openings, and in such embodiments, this region 46 provides an unbroken panel upon which information 48 can be presented.

D1 is selected to mark standard radii for arches or circular segments designed for a particular task, e.g., carpentry, framing, bricklaying, etc. Applicant has determined that standard D1 values on framing square 10 permit a user to quickly select standard arc size to mark out and/or measure a completed construction using framing square 10 without need for a separate arc marking tool. For example, the user measures the doorway arch with a standard value of D1 on framing square 10.

As shown in FIG. 3, array 42 includes at least two marking openings 44 spaced from each other in the longitudinal direction, shown as distance D2. In a specific embodiment, array 42 includes at least two and less than twelve marking openings 44, specifically at least four and less than ten marking openings 44, and more specifically, at least five and less than eight marking openings 44. In various embodiments, D2 is less than 2 inches and greater than ½ inch and more specifically is between ¾ inches and 1 and ½ inches. In a specific embodiment, array 42 includes five marking openings 44 each spaced 1 inch from each other. Marking openings 44 are spaced from each other such that the total distance from pivot opening 40 to each marking opening 44 corresponds to the radius of a common or standard sized arc that the user of framing square 10 may need to mark out.

In some embodiments, framing square 10 includes an array 42 of marking openings 44 formed through blade 12. The array 42 of marking openings 44 is located a first distance D1 from pivot opening 40. Specifically, distance D1 is measured from a center of pivot opening 40 to a center of proximal marking opening 62. The array 42 of marking openings 44 includes at least two marking openings 44, wherein the center of each marking opening 44 is separated from each other by a second distance D2. In some embodiments, the first distance D1 is greater than the second distance D2. In some embodiments, D1 is at least 3 times greater than D2, specifically, D1 is at least 6 times greater than D2, and more specifically, D1 is at least 12 times greater than D2.

In some embodiments, the array 42 of marking openings 44 comprises five marking openings 44. Each marking opening 44 corresponding to an arc measured between pivot opening 40 and one of the five marking openings 44. The distance D1 from pivot opening 40 to a first or proximal marking opening 62 is between 13 inches and 15 inches. The distance D1 plus D2 to a second marking opening 44 is between 14 inches and 16 inches. The distance D1 plus 2×D2 to a third marking opening 44 is between 15 inches and 17 inches. The distance D1 plus 3×D2 to a fourth marking opening 44 is between 16 inches and 18 inches. The distance D1 plus 4×D2 (e.g., distance D3) to a fifth or distal marking opening 64 is between 17 inches and 19 inches. In the specific embodiment shown, array 42 includes a proximal marking opening 62 corresponding to a 14 inch radius, a marking opening 44 corresponding to a 15 inch radius, a marking opening 44 corresponding to a 16 inch radius, a marking opening 44 corresponding to a 17 inch radius, and a distal marking opening 64 corresponding to an 18 inch radius. In this way, framing square 10 is constructed to fit the size requirements of an arc for a particular project.

As further shown in FIG. 3, marking array 42 includes a third or total distance D3. D3 represents the total distance across array 42 of marking openings 44. In other words, D3 defines the total length from a first or proximal marking opening 62 to a last or distal marking opening 64 of marking array 42. Two or more marking openings 44 are formed in blade 12 and define a distance, e.g., D3, between a center of proximal marking opening 62 and a center of a last or distal marking opening 64. In some embodiments, D3 is less than a length of distal solid region 46 of blade 12 along longitudinal axis 58.

In various embodiments, D1 is at least 1.5 times greater than D3, specifically D1 is at least 1.75 times greater than D3, specifically D1 is at least 2 times greater than D3, specifically D1 is at least 2.25 times greater than D3, and more specifically, D1 is at least 2.5 times greater than D3. In various embodiments, a ratio of D1 (e.g., from pivot opening 40 to proximal marking opening 62) divided by D3 (e.g., from proximal marking opening to distal marking opening 64) is between 1 and 5, specifically between 2 and 4. Stated differently, the ratio of D1 to D3 is between 1 and 5, or specifically between 2 and 4. The length of D3 increases or decreases by adding or removing marking openings 44 within marking array 42. The length of D3 also increases or decreases by the distance D2 between markings openings 44.

In various embodiments, D2 is between ½ and 2 inches, and D3 is between 2 inches and 20 inches, specifically between 4 inches and 10 inches, and more specifically between 5 inches and 8 inches. In another embodiment, D2 is between ½ inch, and 2 inches and D3 is between 2.5 inches and 16 inches, specifically between 4 inches and 10 inches, and more specifically between 5 inches and 8 inches. In various embodiments, a ratio of D1 to D2 is between 0.2 and 5, specifically between 0.25 and 4.5. In some embodiments, the standard spacing of D2 (e.g., 1 inch) generates an array of common arc lengths from the same framing square 10. For example, framing square 10 generates a two-inch ring from two concentric circles with a 12-inch arc length and a 14-inch arc length. Similarly, the standard offset enables the user to quickly generate concentric and/or tangent circles of a standard radius.

In some embodiments, framing square 10 includes distal solid region 56 extending along longitudinal axis 58 of blade 12. A fourth or terminal distance D4 is defined from an end of marking array 42 (e.g., the center of distal marking opening 64) to an end or terminus of blade 12 (e.g., outer minor edge 24). In various embodiments, a ratio of D3 (e.g., the length of marking region 54) to D1 (e.g., the length of proximal solid region 46), is between 2 and 5. In some embodiments, a ratio of D4, defining the length of distal solid region 56, to D1, the length of proximal solid region 46, is between 3 and 6.

Distal solid region 56 of blade 12 is coupled to marking array 42 region. Distal solid region 56 extends along longitudinal axis 58 of blade 12. Proximal marking opening 62 of marking array 42 couples to proximal solid region 46 on a first side. Proximal solid region 46 couples to corner section 16 forming blade 12. Opposite the first side, on a second side, distal marking opening 64 couples to distal solid region 56 of blade 12. In this way, distal solid region 56 further extends blade 12 along longitudinal axis 58.

In some embodiments, the length D1 of proximal solid region 46 of blade 12 extending along longitudinal axis 58 is equal to a total length D5 of tongue 14, as defined from pivot opening 40 to outer minor edge 34. As shown, D5 extends along transverse axis 60 in a direction perpendicular to longitudinal axis 58. Keeping a ratio of D1 to D5 at or near one means that the length of D1 is the same as or similar to the length of D5. In this way, D5 serves as a visual check for the length of the arc created between the pivot opening 40 and the proximal marking opening 62. D5 can then be used to see the intersection of the arc generated by a marking opening 44 (e.g., proximal marking opening 62 or distal marking opening 64) of framing square 10 at a 90° radius.

Referring to FIG. 1, a total length D6 of blade 12 is shown as the sum of D1, D3, and D4. In other words, distance D6 extends from pivot opening 40 to outer minor edge 24. In various embodiments, a ratio of D1 to D6 is between 0.4 and 0.8, specifically between 0.5 and 0.7. In some embodiments, the ratio of D3 to D6 is between 0.1 and 0.3, specifically between 0.15 and 0.25. In some embodiments, the ratio of D4 to D6 is between 0.1 and 0.2. These ratios provide framing square 10 an overall or total size that is proportionate to a cut length. For example, a first framing square 10 that is configured for a standard cut of between 14 inches and 18 inches will have a first size, for example based on the ratio of D1 to D6, while a second framing square 10 configured for a standard cut of between 18 inches and 22 inches will have a second size. Distance D4 may change the ratio from the standard first size to standard second size for a 14 inch to 18-inch framing square without a distal solid region 56. For example, an operator may use distal solid region 56 as a handle to mark out a radius at a marking opening 44. The ratios enable D4 to be larger enough to grasp for a standard radius at marking opening 44.

FIG. 2 shows a stress relief 66 between inner longitudinal edge 20 of blade 12 and inner transverse edge 30 of tongue 14. Stress relief 66 may enable framing square 10 to reduce stress concentrations factors in corner section 16 when framing square 10 is rotated about pivot opening 40. For example, if a user grabs tongue 14 to rotate a writing or marking utensil 15 placed within a marking opening 44, the user applies bending stresses between blade 12 and tongue 14. Stress relief 66 reduces the stress concentration factor of the bending stress in corner section 16 that is induced by the user from rotating framing square 10.

As shown in FIG. 3, to facilitate the user's identification and selection of one of the marking openings 44, framing square 10 includes a border 50 surrounding array 42. Border 50 may be a printed or painted line surrounding all openings 44. In other embodiments, border 50 may be an etched line or a recessed section that highlights the location of marking openings 44.

In various embodiments, marking openings 44 are sized to receive the point of marking utensil 15 while also ensuring an accurately sized arc. Marking openings 44 may be sized to receive a particular tool, for example by including long narrow slots configured to receive the blade of a knife. Marking openings 44 may be configured to receive a variety of commonly sized tools including a knife, a razor, a screwdriver, a pen, and/or a pencil, including grease pencils and carpeting pencils. Similarly, pivot opening 40 is sized to receive a common sized tool (e.g., the point of a knife or screwdriver) or a fastener 45 (e.g., a nail or screw) about which framing square 10 is rotated during the process of marking of an arc.

In various embodiments the maximum dimension of marking openings 44 and/or pivot opening 40 is less than 1 inch, specifically is between 1/16 inch and 3/4 inch, specifically between 1/8 inch and 5/8 inch, and more specifically between 1/4 inch and 1/2 inch. In a specific embodiment, a diameter of pivot opening 40 is between 1/16 inches and 3/4 inches, the diameters of each marking opening 44 is between 1/8 inch and 5/8 inch, and the length of proximal solid region 46 is greater than 6 inches, and the distance D2 between the center of a first marking region opening and the center of a second marking region opening is between 1/2 inch and 2 inches. Other combinations of the dimensions for the pivot opening 40, marking opening 44, proximal solid region 46 and distance D2 may combine different dimensions outlined above for these parameters to customize the parameters for specific job requirements and arc dimensions.

In various embodiments, a method of marking an arc (e.g., preceding the formation of an arc-shaped cut) on a workpiece 68 utilizing a framing square, such as framing square 10, is provided. In such embodiments, framing square 10 is placed in contact with a surface of workpiece 68. The framing square 10 is pivotally fixed to workpiece 68 at a pivot point, such as pivot opening 40. Marking utensil 15 is inserted through a marking opening 44, such as one of the marking openings 44, located a distance from the pivot opening 40 corresponding to the desired radius of an arc to be marked on workpiece 68. The framing square 10 is rotated about the pivot opening 40 such that an arc-shaped mark is formed by marking utensil 15 on workpiece 68. The radius of the arc-shaped mark corresponds to the distance between pivot opening 40 and marking opening 44 through which marking utensil 15 is inserted. In various embodiments, the method includes forming a cut through workpiece 68 along the arc-shaped mark.

For example, method 100 forms an arc-shaped marking or cut using framing square 10. Method 100 includes a first step 102 of positioning framing square 10 in contact with a surface of a workpiece. A second step 104 of positioning pivot opening 40 defined within corner section 16 of framing square 10. A third step 106 of positioning marking utensil 15 (e.g., a pen, a pencil, a knife) through marking opening 44 formed through blade 12 of framing square 10, wherein marking opening 44 is located a first distance D1 from pivot opening 40. And a fourth step 108 of rotating framing square 10 and marking utensil 15 about pivot opening 40, such that an arc-shaped mark is formed by marking utensil 15 on the surface of workpiece 68, wherein a radius of the arc-shaped mark corresponds to the first distance D1. In some embodiments, the method further includes a fifth step 110 of forming a cut through workpiece 68, wherein the marking utensil 15 is a blade.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A framing square, comprising:

a blade section;

a tongue section;

a corner section interconnecting the blade section and the tongue section such that the blade section is coupled to the tongue section at a right angle, the blade section, the corner section and the tongue section together forming an L-shape;

a pivot opening defined within the corner section;

an opening formed through the tongue section, the opening located along a midline of a transverse axis of the tongue section; and an array of marking openings formed through the blade section, the array of marking openings being located a first distance from the pivot opening, the array of marking openings comprises at least two openings spaced from each other by a second distance, wherein the first distance is greater than the second distance.

2. The framing square of claim 1, wherein the first distance is greater than 6 inches and the second distance is between ½ inches and 2 inches.

3. The framing square of claim 1, further comprising a border surrounding the array of marking openings.

4. The framing square of claim 1, wherein the blade section, the tongue section, and the corner section comprise an integral and continuous piece of a metal material and wherein the pivot opening is collinear with all of the array of marking openings along a midline of a longitudinal axis of the blade section.

5. The framing square of claim 4, wherein a ratio of the first distance to the second distance, such that ratio is defined as the first distance divided by the second distance, is between 0.2 and 5.

6. The framing square of claim 5, further comprising:

an inner longitudinal edge extending along the blade section;

an outer longitudinal edge extending along the blade section, the inner longitudinal edge being parallel and opposite to the outer longitudinal edge along the blade section;

an inner transverse edge extending along the tongue section; and an outer transverse edge extending along the tongue section, wherein the pivot opening is formed through a boundary between the corner section and the blade section such that the pivot is collinear with the inner transverse edge of the tongue section.

7. The framing square of claim 1, wherein the array of marking openings comprises five marking openings, the marking openings corresponding to an arc measured between the pivot opening and the five marking openings, the distance from the pivot opening to a first marking opening being between 13 inches and 15 inches, a second marking opening being between 14 inches and 16 inches, a third marking opening being between 15 inches and 17 inches, a fourth marking opening being between 16 inches and 18 inches, and a fifth marking opening being between 17 inches and 19 inches.

8. A framing square, comprising:

a blade extending in a first direction along a longitudinal axis, the blade comprising:

a solid region extending a length along the longitudinal axis of the blade; and a marking region coupled to the solid region of the blade and extending along the longitudinal axis of the blade;

a tongue extending in a second direction along a transverse axis perpendicular to the blade, the tongue comprising a solid region extending a length along the transverse axis of the tongue;

a corner section coupling the solid region of the blade to the solid region of the tongue, the corner, the blade and the tongue together forming an L-shape;

a pivot opening defined within the corner section; and two or more marking openings formed in the blade, the marking openings comprising a distance between a center of a first marking opening and a center of a last marking opening is less than a length of the solid region of the blade along the longitudinal axis an opening formed through the tongue, the opening located along a midline of the transverse axis of the tongue.

9. The framing square of claim 8, wherein a width of the blade measured perpendicular to the longitudinal axis is greater than a width of the tongue measured perpendicular to the transverse axis.

10. The framing square of claim 8, wherein the tongue and the blade form a rectangular shaped section such that the tongue intersects the blade at a 90° angle at the corner section and the blade is longer than the tongue.

11. The framing square of claim 8, wherein the blade, the tongue, and the corner section comprise an integral and continuous piece of material.

12. The framing square of claim 8, wherein the pivot opening and the at least two marking openings are collinear with each other.

13. The framing square of claim 12, wherein a central longitudinal axis of the blade intersects the pivot opening and the at least two marking openings.

14. The framing square of claim 8, further comprising a distal solid region of the blade coupled to the marking region and extending along the longitudinal axis of the blade, wherein a first side of the marking region couples to a proximal solid region of the blade that is coupled to the corner section, and a second side of the marking region, opposite the first side, is coupled to the distal solid region of the blade further extending along the longitudinal axis.

15. The framing square of claim 14, wherein a ratio of a length of the marking region to a length of the proximal solid region along the longitudinal axis of the blade is between 2 and 5, and the ratio of a length of the distal solid region to the length of the proximal solid region is between 3 and 4, and wherein the length of the proximal solid region is greater than 6 inches and equal to a length of the tongue extending along a transverse axis that is perpendicular to the longitudinal axis.

16. The framing square of claim 8, wherein a diameter of the pivot opening is between 1/16 inch and 3/4 inch, wherein diameters of each of the marking openings are between 1/8 inch and 5/8 inch, and the length of the solid region is greater than 6 inches, wherein the distance between the center of a first marking region opening and the center of a second marking region opening is between 1/2 inch and 2 inches.

17. The framing square of claim 8, further comprising more than 4 and less than 10 marking openings.

18. A method of forming an arc-shaped marking using a framing square, the method comprising:

positioning a framing square in contact with a surface of a workpiece;

positioning a pivot through a pivot opening defined within the framing square;

positioning a marking utensil through a marking opening formed through the framing square, wherein the marking opening is located a first distance extending in a first direction from the pivot, wherein the first distance is equal to a second distance extending from the pivot to an outer edge of the framing square in a second direction, the second direction perpendicular to the first direction;

rotating the framing square and marking utensil about the pivot, such that an arc-shaped mark is formed by the marking utensil on the surface of the workpiece, wherein a radius of the arc-shaped mark corresponds to the first distance; and using the framing square to view an intersection of the arc-shaped mark generated at a 90° radius.

19. The method of claim 18, further comprising forming a cut through the workpiece, wherein the marking utensil comprises a blade.

* * * * *